United States Patent [19]

Stinnett et al.

[11] Patent Number: 4,722,316

[45] Date of Patent: Feb. 2, 1988

[54] SLINGSHOT

[76] Inventors: James C. Stinnett, 1101 Walter Dr., Apt. D, Dallas, Tex. 75211; George Spector, 233 Broadway; RM 3815, New York, N.Y. 10007

[21] Appl. No.: 2,641

[22] Filed: Jan. 12, 1987

[51] Int. Cl.[4] ..... F41B 7/00; F41F 7/00

[52] U.S. Cl. ..... 124/20 R

[58] Field of Search ..... 124/17–22

[56] References Cited

U.S. PATENT DOCUMENTS

| | | | |
|---|---|---|---|
| 2,645,217 | 7/1953 | Fisher | 124/20 B |
| 2,715,895 | 6/1952 | Loveless | 124/20 R |
| 3,101,704 | 2/1962 | McCormick | 124/20 R |
| 3,306,278 | 2/1967 | Spatari | 124/22 |
| 3,923,034 | 12/1975 | Wolf | 124/20 R |
| 4,050,439 | 9/1977 | Rudy | 124/20 R |
| 4,569,324 | 2/1986 | Garcia | 124/20 R |

FOREIGN PATENT DOCUMENTS

| | | | |
|---|---|---|---|
| 2031743 | 5/1980 | United Kingdom | 124/20 R |

*Primary Examiner*—Richard C. Pinkham
*Assistant Examiner*—Mark S. Graham

[57] ABSTRACT

A slingshot is provided and consists of a forked handle, a missile receiving pouch and resilient members connecting the pouch to the handle whereby the resilient members are solid cylindrical rubber tubes to improve operating efficiency of the slingshot. In a modification the forked handle is angularly adjustable for greater accuracy.

5 Claims, 5 Drawing Figures

SLINGSHOT

BACKGROUND OF THE INVENTION

The instant invention relates generally to projectile launching devices and more specifically it relates to a slingshot.

Numerous projectile launching devices have been provided in prior art that are adapted to propell pellets and arrows. For example, U.S. Pat. Nos. 2,715,895; 3,306,278 and 3,923,034 all are illustrative of such prior art. While these units may be suitable for the particular purpose to which they address, they would not be as suitable for the purposes of the present invention as heretofore described.

SUMMARY OF THE INVENTION

A primary object of the present invention is to provide a slingshot that will overcome the shortcomings of the prior art devices.

Another object is to provide a slingshot which incorporates resilient members that are solid cylindrical rubber tubes so as to improve operating efficiency of the slingshot.

An additional object is to provide a slingshot that is angular adjustable whereby greater accuracy is assured when operating the slingshot.

A further object is to provide a slingshot that is simple and easy to use.

A still further object is to provide a slingshot that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
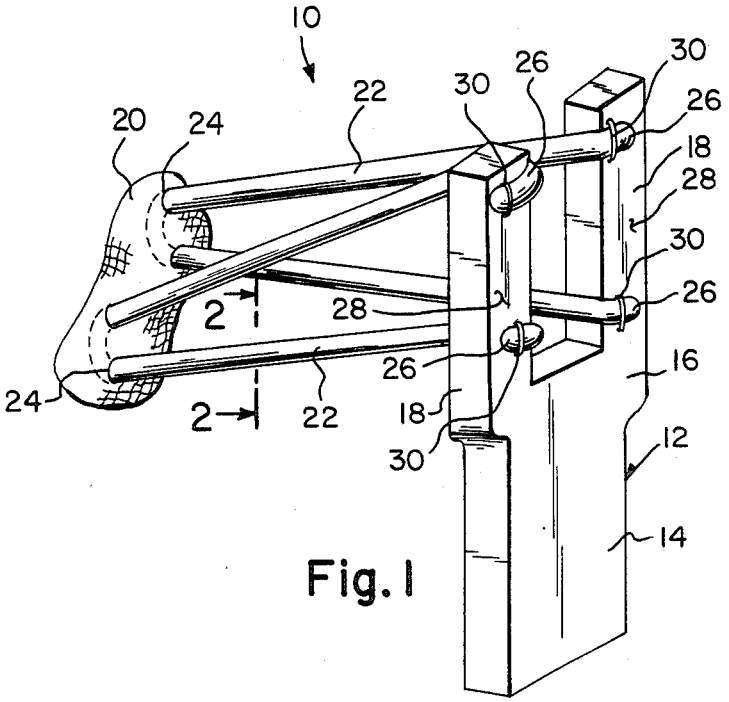
FIG. 1 is a perspective view of the invention.
Figure 2:
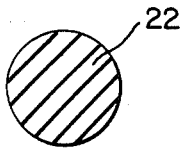
FIG. 2 is an enlarged cross sectional view taken along line 2—2 in FIG. 1.

Turning now descriptively to the drawings, in which similar reference characters denote similar elements throughout the several views, FIG. 1 illustrates a slingshot 10 consisting of a frame member 12 that has a handle portion 14, a yoke portion 16 and a pair of upstanding arm portions 18. A missile receiving pouch 20 and a pair of resilient members 22 are also provided. Each of the resilient members 22 are circular in cross section (see FIG. 2) and extends through one side 24 of the pouch 20 with both ends 26 spaced apart and secured to one of the arm portions 18. The resilient members 22 are tensioned and then released to fling a missile (not shown) from the pouch 20 with increased velocity and efficiency. Each of the resilient members 22 are fabricated out of solid rubber tubing and has both ends 26 spaced apart and secured to forward surface 28 of one of the arm portions 18 with staple-like fasteners 30.

Figure 3:
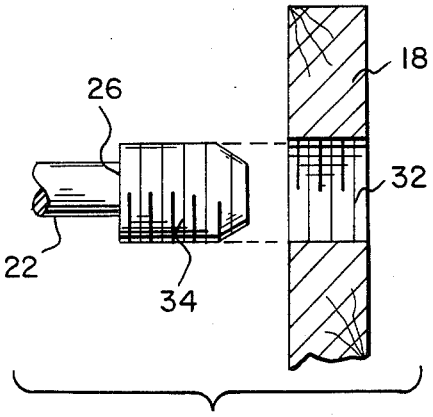
FIG. 3 is an enlarged cross sectional view with parts broken away of a modification showing another adjustable way to secure the elastic member to the arm.

FIG. 3 shows a modification in which each of the arm portions 18 has spaced apart threaded holes 32 therethrough. Each of the resilient members 22 is fabricated out of solid rubber tubing and has both ends 26 spaced apart.

A pair of threaded coupler members 34 are provided in which each is affixed to one end 26 of the resilient member 22 to be received within one of the threaded holes 32 in the arm portion 18.

Figure 4:
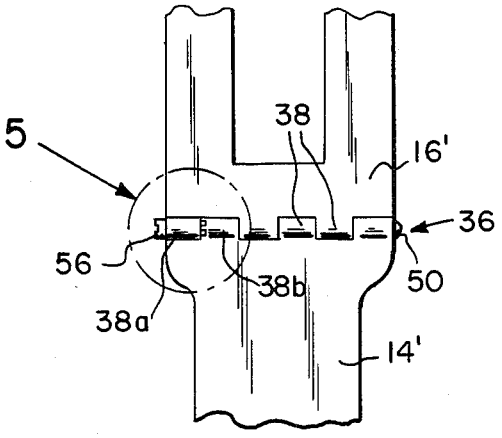
FIG. 4 is a front view with parts broken away of another modification showing an angular adjustable slingshot having a hinge between the yoke and handle.
Figure 5:
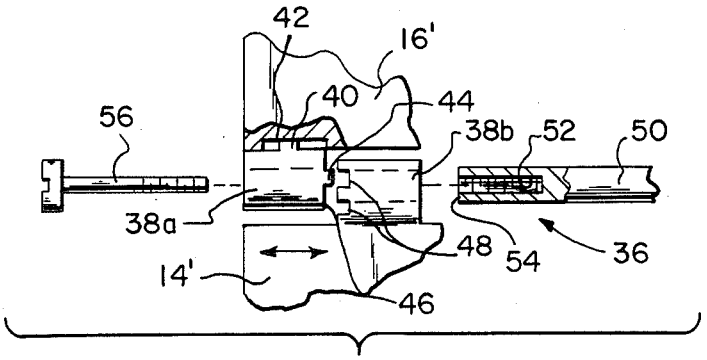
FIG. 5 is an enlarged detail view with parts in section as indicated by numeral 5 in FIG. 4 showing the locking barrel therein.

FIGS. 4 and 5 shows another modification in which an angular adjustable handle portion 14' is provided that includes a lockable hinge 36 between the yoke portion 16' and the handle portion 14'. The lockable hinge 36 consists of a plurality of barrels 38, some of which are formed on the yoke portion 16' and some of which are formed on the handle portion 14'. One end barrel **38*a* on the yoke portion 16' is slideable and has a finger 40 to ride in a track 42 in the yoke portion and a tooth 44 extending from inner side 46 thereof. One of the barrels 38*b* on the handle portion 14' has at least two side notches 48 therein, each to receive the tooth 44 when the yoke 16' is turned. A pin 50 is provided and has a threaded hole 52 in end 54 thereof. A threaded bolt 56 passes through the end barrel 38*a* to be received within the threaded hole 52 in the pin 50 to lock the tooth 44 in one of the notches 48, in the barrel 38*b* on the handle portion 14'**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A slingshot comprising:

(a) a frame member having a handle portion, a yoke portion and a pair of upstanding arm portions;

(b) a missile receiving pouch; and (c) a pair of resilient members each of said resilient members being circular in cross section and extending through one side of said pouch with both ends of one of said resilient members secured to one of said arm portions at spaced apart locations, and both ends of the other of said resilient members secured to the other of said arm portions at spaced apart locations. said resilient members being tensioned and then released to fling a missile from said pouch with increased velocity and efficiency.

2. A slingshot as recited in claim 1, wherein each of said resilient members being fabricated out of solid rubber tubing and having both ends spaced apart and secured to forward surface of one of said arm portions with staple-like fasteners.

3. A slingshot as recited in claim 1, further comprising:

(a) each of said arm portions having spaced apart threaded holes therethrough;

(b) each of said resilient members being fabricated out of solid rubber tubing and having both ends spaced apart; and (c) a pair of threaded coupler members, each of which is affixed to one end of said resilient member to be received within one of said threaded holes in said arm portion.

4. A slingshot as recited in claim 1, further comprising an angular adjustable handle portion including a lockable hinge between said yoke portion and said handle portion.

5. A slingshot as recited in claim 4, wherein said lockable hinge comprises:

(a) a plurality of barrels, some of which are formed on said yoke portion and some of which are formed on said handle portion with said one end barrel on said yoke portion being slideable having a finger to ride in a track in said yoke portion and a tooth extending from inner side thereof and one of said barrels on said handle portion having at least two side notches therein each to receive said tooth when said yoke is turned;

(b) a pin having a threaded hole in an end thereof; and (c) a threaded bolt passing through said end barrel to be received within said threaded hole in said pin to lock said tooth in one of said notches in said barrel on said handle portion.

* * * * *